United States Patent [19]

Matsuo

[11] Patent Number: 4,919,054

[45] Date of Patent: Apr. 24, 1990

[54] CONVEYING APPARATUS

[75] Inventor: Yukito Matsuo, Yokohama, Japan

[73] Assignee: Kabushiki Kaisha Toshiba, Kawasaki, Japan

[21] Appl. No.: 250,986

[22] Filed: Sep. 28, 1988

Related U.S. Application Data

[63] Continuation of Ser. No. 9,043, Jan. 27, 1987, abandoned, which is a continuation of Ser. No. 716,170, Mar. 26, 1985, abandoned.

[30] Foreign Application Priority Data

Mar. 26, 1984 [JP] Japan ..... 59-58854

[51] Int. Cl.[5] ..... B61B 3/00

[52] U.S. Cl. ..... 104/94; 104/292

[58] Field of Search ..... 104/89, 94, 95, 106, 104/107, 109, 242, 243, 244, 244.1, 245, 246, 247, 290, 292, 119; 105/148, 155

[56] References Cited

U.S. PATENT DOCUMENTS

| | | | |
|---|---|---|---|
| 2,807,058 | 9/1957 | Morgan | 105/155 |
| 3,540,380 | 11/1970 | Tumpak et al. | 104/246 |
| 3,580,183 | 5/1971 | Nearman | 104/94 |
| 3,616,762 | 11/1971 | Benner | 104/290 |
| 3,675,585 | 7/1972 | Wiart et al. | 104/292 |
| 3,696,752 | 10/1972 | Bourg | 104/94 |
| 3,834,316 | 10/1974 | Hennings | 104/94 |
| 3,950,952 | 4/1976 | Krings | 104/244.1 |
| 4,172,423 | 10/1979 | Monne | 105/155 |
| 4,324,185 | 4/1982 | Vinson | 104/283 |
| 4,362,108 | 12/1982 | Jenkner | 104/94 |

FOREIGN PATENT DOCUMENTS

| | | |
|---|---|---|
| 1246566 | 8/1967 | Fed. Rep. of Germany . |
| 1248558 | 8/1967 | Fed. Rep. of Germany . |
| 1956894 | 12/1970 | Fed. Rep. of Germany . |
| 6800224 | 6/1972 | Fed. Rep. of Germany . |
| 1808681 | 3/1981 | Fed. Rep. of Germany . |
| 55-30726 | 3/1980 | Japan . |
| 1384101 | 2/1975 | United Kingdom . |
| 1409391 | 10/1975 | United Kingdom . |
| 1594068 | 3/1978 | United Kingdom . |
| 2099772 | 12/1982 | United Kingdom . |
| 2113633 | 8/1983 | United Kingdom . |
| 2114520 | 8/1983 | United Kingdom . |

*Primary Examiner*—Margaret A. Focarino
*Assistant Examiner*—Gary C. Hoge
*Attorney, Agent, or Firm*—Foley & Lardner, Schwartz, Jeffery, Schwaab, Mack, Blumenthal & Evans

[57] ABSTRACT

In a conveying apparatus wherein a carriage is driven by a linear motor to run along guide rails, the guide rails comprise two parallel guide members, each having a first guide surface that prevents lateral movement of the carriage, and a second guide surface that prevents vertical movement of the carriage. The carriage comprises first wheels disposed between upper and lower surfaces of the carriage for rolling along the first guide surfaces and second wheels disposed spaced apart from the first wheels in the running direction of the carriage to roll along the second guide surfaces.

8 Claims, 5 Drawing Sheets

CONVEYING APPARATUS

This application is a continuation of 07/009,043, filed Jan. 27, 1987, now abandoned which is a continuation of 06/716,170, filed Mar. 26, 1985, now abandoned.

BACKGROUND OF THE INVENTION

1. Field of the Invention

This invention relates to conveying apparatus in which a carriage imparted with a propelling force by a linear motor or the like motive means is run under its inertia along guide rails.

2. Description of the Prior Arts

In a conventional convertion conveying system, the carriage is generally driven by a drive source mounted thereon for running along a predetermined conveying path. With such conveying system, however, due to the installation of the drive source, the size and weight of the carriage is increased.

Accordingly, when the carriage runs very fast, there arise problems such that a large centrifugal force is generated at a curved path and energy supply becomes required.

On the other hand, there has been proposed a conveying system in which the carriage is not provided with a drive source but imparted with a propelling force from outside thus running the carriage with its own inertia. For example, in a conveying system utilizing a linear induction motor, the carriage is provided with a reaction plate which is supplied with magnetic flux varying with time so as to create in the reaction plate a definite forward or reverse propelling force thereby running or stopping the carriage. This system can miniaturize the carriage, can reduce its weight and can run the carriage at a high speed.

When conveying an object by means of a conveying system driven by a linear motor, if it is possible to convey the object, not only in the horizontal direction but also in the vertical direction, it would be possible to provide a three dimensional conveying system efficiently utilizing the space.

A prior art system enabling three dimensional conveyance is disclosed in Japanese Patent Application No. 102589/1978 (Japanese Laid Open Patent Specification No. 30726/1980). According to the conveying system disclosed therein, since guide members for limiting the transverse movement of the carriage are provided for the lower surface of the carriage, the guide rails for guiding the carriage and the carriage itself become large and complicated so that it is impossible to decrease the size of the conveying system while ensuring a desired capacity of transportation.

Further, when running three dimensionally, the carriage should be restricted in upward movement by upper guide rails. However, since the carriage is provided with only one pair of wheels vertically, there occurs great frictional force between the wheels and the upper guide rail due to the reverse rotation of the wheels. (This Japanese Patent Application does not disclose the three-dimensional running case.)

SUMMARY OF THE INVENTION

It is an object of this invention to provide an improved carriage driven by a linear motor that can be manufactured compact and can run at high speeds without the danger of derailment.

Another object of this invention is to provide an improved carriage driven by a linear motor that can run not only in the horizontal direction but also in the vertical direction.

According to this invention, there is provided a conveying apparatus of the type wherein a carriage is run along guide rails, characterized in that the guide rails include two parallel guide members each having a first guide surface that prevents lateral movement of the carriage, and a second guide surface that prevents vertical movement of the carriage and that the carriage includes first guided members positioned between upper and lower surfaces of the carriage for rolling along the first guide surfaces of the guide member, and second guided members longitudinally spaced from the first guided members to move along the second guide surfaces.

According to a modified embodiment of this invention the guide rails extend not only in the horizontal direction but also in the vertical direction, thus enabling three dimensional running.

DESCRIPTION OF THE PREFERRED EMBODIMENTS

Figure 1:
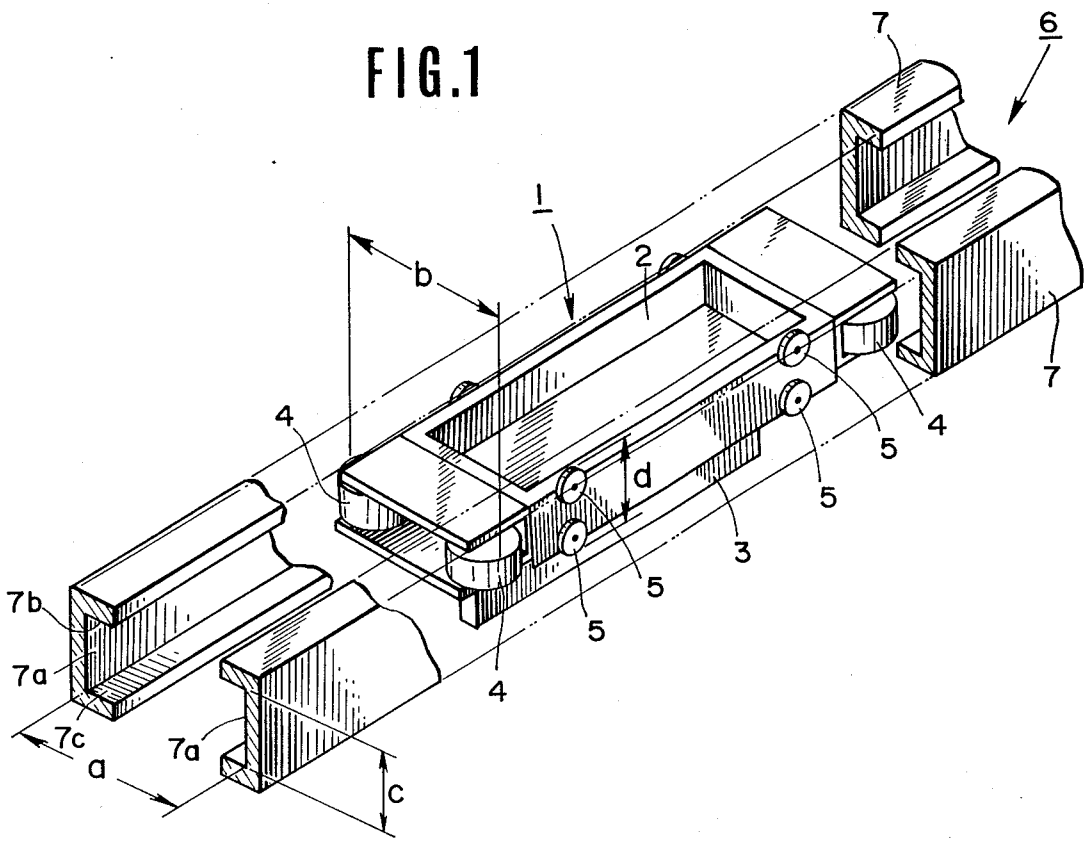
FIG. 1 is a perspective view showing a carriage and guide rails embodying the invention.
Figure 2:
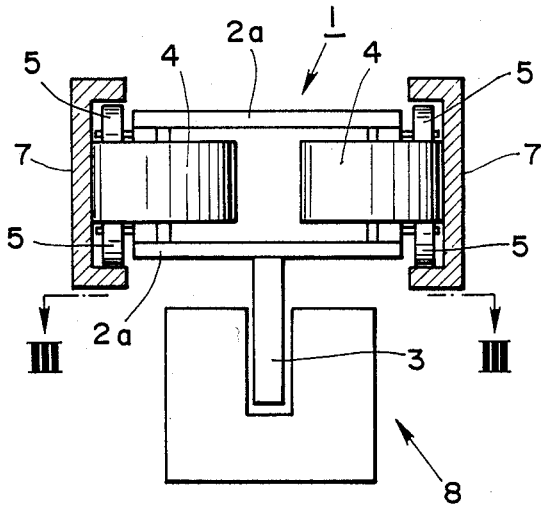
FIG. 2 is a cross-sectional view of the conveying path for the carriage.
Figure 3:
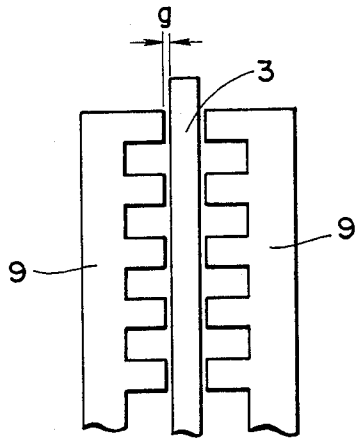
FIG. 3 is a sectional view taken along a line III—III in FIG. 2.
Figure 4A:
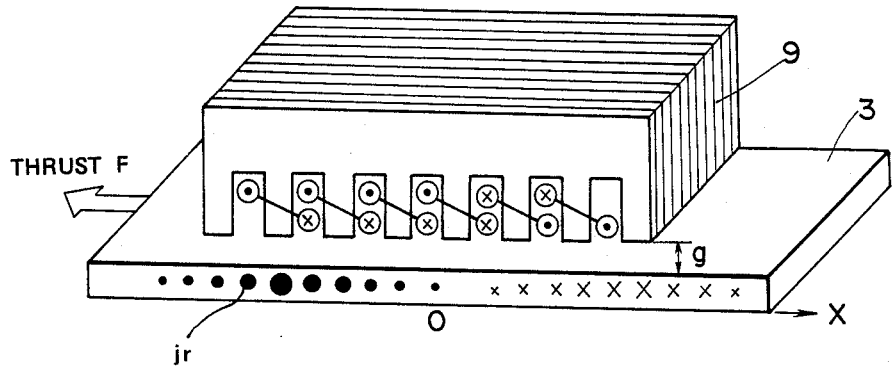
FIG. 4*a* is a perspective view useful to explain the principle of a linear induction motor.

As shown in FIGS. 1 and 2, a carriage 1 comprises a casing 2 adapted to carry an object, and a reaction plate 3 vertically depending from the bottom of the casing 2. The reaction plate 3 is made of such electric conductor as copper, aluminum or the like material and imparted with forward or reverse propelling force created by the magnetic force generated by the stators 9 to be described later. Two pairs of wheels (guided members) 4 projecting from the side surfaces of the casing 2 are provided on the front and rear sides respectively of the carriage. Furthermore, two pairs of wheels 5 are provided for both ends of each side frame of the carriage. Thus, a total of twelve wheels 4 and 5 are provided. The conveying path 6 for the carriage 1 is formed by a pair of opposed U shaped guide rails 7. The distance a between the confronting inner surfaces 7*a* of the guide rails 7 is slightly larger than the distance b between the outer peripheries of the wheels 4. The distance c between the upper and lower flanges of each rail is slightly larger than the distance d between the outer peripheries of vertically aligned wheels 5. The inner surfaces 7*a*, opposing inner surfaces 7*b* and 7*c* of the upper and lower flanges act as guide surfaces for the wheels 4 and 5. A linear induction motor 8 is provided beneath the conveying path 6. The linear induction motor 8 is constituted by a reaction plate 3 secured to the bottom of the casing 2 to act as a movable member, and a pair of stators 9 disposed on the opposite sides of the reaction plate 3. As shown in FIGS. 3 and 4*a*, each stator 9 comprises a lamination of electric sheets punched with teeth and grooves which accommodate coils, not shown. Gaps g of a predetermined width are formed between the reaction plate 3 and the stators 9.

Figure 4B:
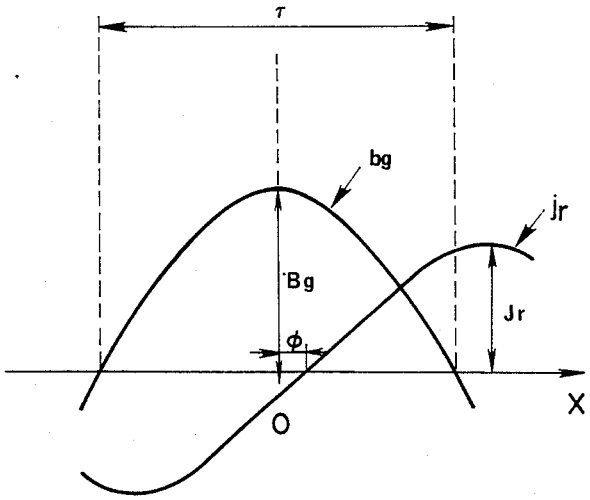
FIG. 4*b* is a graph showing the relationship between magnetic flux and eddy current.

The principle of generating the forward or reverse propelling force of the linear induction motor will be described with reference to FIGS. 4*a* and 4*b*. FIG. 4*a* is a perspective view showing a flat plate one side type linear induction motor, while FIG. 4*b* shows the relationship between the magnetic flux bg and the eddy current. When two or three phase alternating current is passed through the coils of the stators, the instantaneous value bg(T) of the flux density in the gaps 9 is expressed by $$bg = Bg \cos(wt - \pi x/\tau)$$

where

Bg: crest value of the flux density, $w = 2\pi f$: angular frequency of source voltage (red/s)

f: frequency (Hz)

t: time (s)

x: distance (m) along the stator surface, $\tau$: pole pitch

The pole pitch $\tau$ represents the length of one half period of the flux density bg. Since the magnetic flux generated by the stators 9 is an alternating flux, eddy current is induced in the reaction plate 3, that is, the movable member according to Len's law. Symbols • and x applied to the section of the reaction plate 3 shown in FIG. 4*a* represents the magnitude and direction of the eddy current. The instantaneous value jr of the eddy current is expressed by $$jr = Jr \sin(wt - \pi X/\tau - \phi)$$

where

Jr: crest value of eddy current $\phi$: phase difference caused by the impedance of reaction plate 3.

Since the flux density bg in the gaps forms a shifting field the product of the flux density bg and the instantaneous value of the eddy current produces a continuous thrust F according to the lefthand law of Fleming. Although this thrust F is produced in the left and right directions as viewed in FIG. 4*a*, since bg x jr in the left region shown in FIG. 4*b* is larger than that in the right region, the reaction plate 3 would be moved toward left. To apply a reverse propelling force to the reaction plate 3, reverse phase alternating current should be passed through the coils of the stators 9. The magnitude of the thrust F can be varied by varying the frequency f or amplitude of the alternating current.

Figure 5:
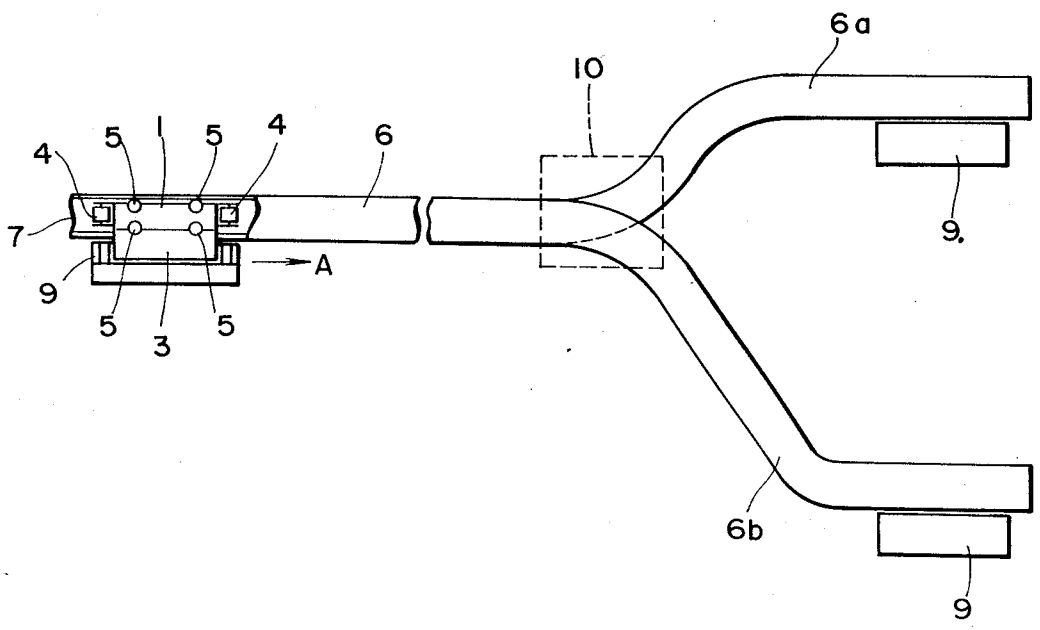
FIG. 5 is a diagrammatic represention of conveying paths.

The conveying path 6 for guiding the carriage 1 imparted with the propelling force as above described will be described with reference to FIG. 5. The conveying path 6 shown in FIG. 5 comprises a switch 10 which selects the carriage 1 running in the direction shown in arrow A to proceed along an upper conveying path 6*a* or a lower conveying path 6*b* which are spaced from the path 6*a* in the vertical direction. Beneath the path 6, 6*a* and 6*b* are disposed stators 9 which impart forward or reverse propelling force to the reaction plate 3 of the carriage 1.

The apparatus constructed as above described operates as follows. Application of the propelling force to the carriage 1 can be done by passing 2 or 3 phase alternating current through the coils of the stators so as to generate magnetic flux, thereby inducing eddy current. The product of the flux and the eddy current produces a continuous thrust F according to the lefthand law of Fleming. When the carriage 1 is imparted with the thrust in this manner, wheels 4 and 5 secured to the casing 2 would be caused to run by its inertia while being guided by the U shaped guide rails 7. The guide rails 7 are provided with guide surfaces 7*a* that prevent transverse movement of the carriage 1. Moreover, the guide rails 7 are provided with guide surfaces 7*b* and 7*c* which prevent vertical movement of the carriage 1. On the other hand, the carriage 1 is provided with wheels 4 rolling along the guide surfaces 7*a* and wheels 5 rolling along the guide surfaces 7*b* and 7*c*. Consequently, the carriage can run only in the direction A and prevented from moving in the other directions. For this reason, even when the conveying path 6 guiding the carriage 1 is bent in the horizontal and vertical directions, the carriage 1 can move in three dimensional directions without derailment. Although the conveying path shown in FIG. 5 is bent only in the vertical direction, the path can be bent in a horizontal plane. In this embodiment, wheels 4 and 5 provided for the carriage 1 decrease the frictional resistance with respect to the guide surfaces 7*a*, 7*b* and 7*c*, whereby high speed running of the carriage can be ensured even when it runs under its inertia. Since the wheels 4 for preventing the lateral movement of the carriage 1 are secured to the front and rear ends of the carriage 1, it is possible to decrease the lateral dimension of the carriage 1 while maintaining the capacity of loading object of the casing 2 at a constant value, thereby miniaturizing the carriage 1.

Figure 6:
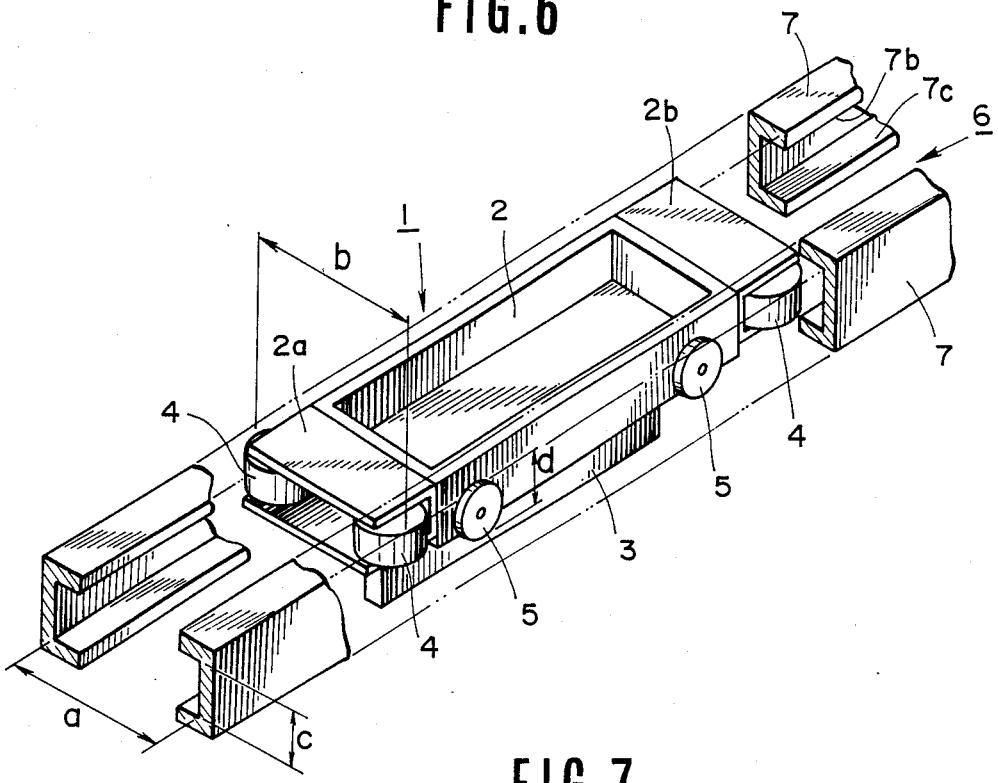
FIG. 6 is a perspective view showing a modified carriage.
Figure 7:
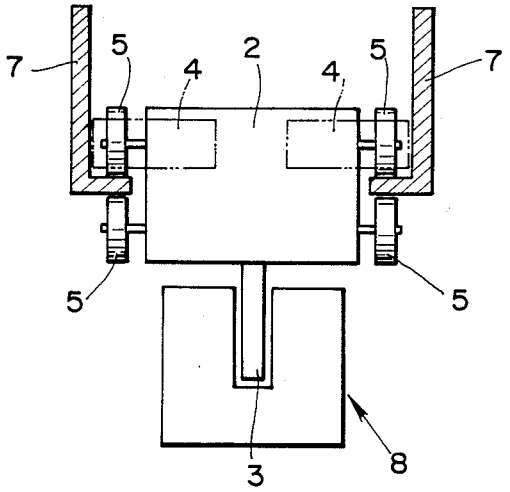
FIG. 7 is a cross-sectional view showing a modified conveying path for the carriage.

It should be understood that the invention is not limited to the specific embodiment described above and that various changes and modifications will be obvious to one skilled in the art without departing from the true spirit and scope of the invention as defined in the appended claims. For example, as shown in FIG. 6, four wheels 5 engaging the upper and lower flanges 7*b* and 7*c* of each guide rail may be provided for the side surfaces of the carriage 1 so as to decrease the number of parts. Furthermore, as shown in FIG. 7, opposing guide rails may be shaped to have a letter L cross-section for clamping respective rails between wheels 5. In FIG. 7, parts corresponding to those shown in FIG. 6 are designated by the same reference numerals. Although in the foregoing embodiments, a linear induction motor was used for imparting the propelling force, other types of linear motor, for example, a linear step motor or a linear direct current can also be used.

What is claimed:

1. A conveying apparatus comprising:

a carriage comprising a casing, having at the bottom a vertically depending reaction plate, adapted to carry an object therein;

driving means, located at predetermined positions outside said carriage for imparting a propelling force to the reaction plate, the propelling force being selectively transferable between an acceleration mode and a deceleration mode;

a guide rail means for guiding said carriage, said guide rail means comprising first and second guide members in parallel with each other, each guide member comprising a first guide surface for restricting movement of said carriage in a first direction corresponding to a lateral direction with respect to the travel of said carriage, wherein said first guide surface of said first guide member is directly opposite said first guide surface of said second guide member, and a pair of oppositely facing second guide surfaces for restricting the movement of said carriage in a second direction perpendicular to said first direction;

a first guide roller group comprising two pairs of first rollers, one pair being rotatably attached to a front end and the other pair being rotatably attached to a rear end of said carriage by shafts extending in said second direction, one of each pair of said first rollers contacting only said first guide surface of said first guide member and the other of each pair of said first rollers contactable only with said first guide surface of said second guide member so as to rotate in opposite directions when said carriage is propelled, thereby restricting movement of said carriage in said first direction; and a second guide roller group comprising at least two pairs of second rollers rotatably attached to each side of said carriage by shafts extending in said first direction and spaced apart from each other in the direction of travel, each paired roller being disposed in a straight line in said second direction, one of each pair of said second rollers contacting a portion of one of said oppositely facing second guide surfaces and the other of each pair of said second rollers contactable with a portion of the other of said oppositely facing second guide surfaces, such that said contact portions are aligned with corresponding contactable portions forming a straight line parallel to said second direction, so as to rotate in opposite directions when said carriage is propelled thereby restricting movement of said carriage in said second direction, whereby said carriage is confined within said guide rail means and operable in three-dimensional travel such that said first and second rollers do not reverse their direction of rotation when said carriage is propelled in a given direction.

2. A conveying apparatus according to claim 1, wherein each of said second guide surfaces of said guide member extends perpendicular to said first guide surface from both the upper end and the lower end of said first guide surface respectively so as to form a U-shaped guide member.

3. A conveying apparatus according to claim 2, wherein each of said paired second rollers is positioned between said pair of second guide surfaces.

4. A conveying apparatus according to claim 2, wherein said U-shaped guide members define a region in which the casing of said carriage is completely included.

5. A conveying apparatus according to claim 1, wherein said second guide roller group is positioned between the front and rear ends of the first guide roller group.

6. A conveying apparatus comprising:

a carriage including a casing adapted to carry an object, said casing having a vertically depending reaction plate, extending from a bottom portion thereof;

driving means, located at predetermined positions outside said carriage for imparting a propelling force to the reaction plate, the propelling force being selectively transferable between an acceleration mode and a deceleration mode;

a guide rail means for guiding said carriage, said guide rail means comprising first and second guide members in parallel with each other, each guide member comprising a first guide surface for restricting movement of said carriage in a first direction corresponding to a lateral direction with respect to the travel of said carriage, wherein said first guide surface of said first guide member is directly opposite said first guide surface of said second guide member, and a pair of second guide surfaces for restricting the movement of said carriage in a second direction perpendicular to said first direction;

a first guide roller group comprising two pairs of first rollers, one pair being rotatably attached to a front end and the other pair being rotatably attached to a rear end of said carriage, wherein one of each pair of said first rollers contacts only said first guide surface of said first guide member and the other of each pair of said first rollers contacts only said first guide surface of said second guide member, so as to rotate in opposite directions when said carriage is propelled, thereby restricting movement of said carriage in said first direction; and a second guide roller group comprising at least a pair of second rollers rotatably attached to each side of said carriage wherein one of said second rollers contacts a portion of one of said guide surfaces and the other of said second rollers contacts a portion of the other of said second guide surfaces, so as to rotate in opposite directions when said carriage is propelled, thereby restricting movement of said carriage in said second direction;

whereby said carriage is confined within said guide rail means and operable in three-dimensional travel such that said first and second rollers do not reverse their direction of rotation when said carriage is propelled in a given direction.

7. A conveying apparatus according to claim 6, wherein said second guide surfaces of said guide member extend perpendicular to said first guide surface from a lower end of said first guide surface so as to form an L-shaped member.

8. A conveying apparatus according to claim 7, wherein said second guide surfaces are positioned between each of said second rollers.

* * * * *